US008152016B2

(12) United States Patent
Berndt et al.

(10) Patent No.: US 8,152,016 B2
(45) Date of Patent: Apr. 10, 2012

(54) COVER WITH RECLOSEABLE APERTURE

(75) Inventors: Manfred Berndt, Karlsbad (DE); Jose-Angel Mora-Fillat, Ettlingen (DE); Jan Eickhoff, Straubenhardt (DE)

(73) Assignee: Agilent Technologies, Inc., Santa Clara, CA (US)

( * ) Notice: Subject to any disclaimer, the term of this patent is extended or adjusted under 35 U.S.C. 154(b) by 1011 days.

(21) Appl. No.: 10/589,319

(22) PCT Filed: Apr. 7, 2004

(86) PCT No.: PCT/EP2004/050476

§ 371 (c)(1), (2), (4) Date: Apr. 12, 2007

(87) PCT Pub. No.: WO2005/097323

PCT Pub. Date: Oct. 20, 2005

(65) Prior Publication Data

US 2007/0257035 A1 Nov. 8, 2007

(51) Int. Cl.
*B65D 43/20* (2006.01)
*B65D 51/18* (2006.01)

(52) U.S. Cl. ..... 220/253; 220/229; 220/254.9; 220/259.5

(58) Field of Classification Search ..... 220/254.1, 220/254.2, 229, 203.17, 203.18, 253, 259.5, 220/254.9
See application file for complete search history.

(56) References Cited

U.S. PATENT DOCUMENTS

| | | | | |
|---|---|---|---|---|
| 2,803,370 | A * | 8/1957 | Lennard | 220/229 |
| 4,206,870 | A * | 6/1980 | DeVries | 383/103 |
| 4,329,857 | A * | 5/1982 | Kittle et al. | 220/229 |
| 4,331,254 | A * | 5/1982 | Haggerty | 220/229 |
| 4,847,050 | A * | 7/1989 | Jenkins et al. | 422/102 |
| 5,024,327 | A * | 6/1991 | Shillington | 206/366 |
| 5,071,017 | A * | 12/1991 | Stull | 215/260 |
| 5,123,574 | A * | 6/1992 | Poulos | 222/362 |
| 5,727,881 | A * | 3/1998 | Domke | 383/103 |
| 5,937,921 | A * | 8/1999 | Guglielmini | 141/351 |
| 5,971,195 | A * | 10/1999 | Reidinger et al. | 220/521 |
| 6,037,168 | A | 3/2000 | Brown | |
| 6,176,384 | B1 * | 1/2001 | Voloshin | 220/253 |
| 6,286,698 | B2 * | 9/2001 | Hague et al. | 215/201 |
| 6,586,063 | B1 * | 7/2003 | Albanesi et al. | 428/35.7 |
| 6,843,387 | B2 * | 1/2005 | Karaki et al. | 220/229 |
| 6,902,076 | B2 * | 6/2005 | Bauer et al. | 215/253 |
| 6,939,513 | B2 * | 9/2005 | Berray et al. | 422/99 |
| 2003/0003023 | A1 * | 1/2003 | Korpela | 422/99 |
| 2003/0052074 | A1 | 3/2003 | Chang et al. | |
| 2003/0052126 | A1 | 3/2003 | Zettle et al. | |

(Continued)

FOREIGN PATENT DOCUMENTS

| | | |
|---|---|---|
| DE | 87 16 420.5 | 3/1988 |

(Continued)

*Primary Examiner* — Anthony Stashick
*Assistant Examiner* — Niki Eloshway

(57) ABSTRACT

A cover for sealing a container and preferably containers for a well plate. The cover is comprised of at least a top layer and a bottom layer structured in a way to form a recloseable aperture. Preferably, each of the layers comprise a recloseable aperture structured as flap, damper, baffle or butterfly valve respectively, wherein the recloseable apertures are arranged on top of each other. In a preferred embodiment of the invention a third moveable layer is arranged between the top and the bottom layer. By moving the middle layer, the aperture in the cover can be closed.

25 Claims, 4 Drawing Sheets

U.S. PATENT DOCUMENTS

| | | | | |
|---|---|---|---|---|
| 2003/0168501 | A1 | 9/2003 | Hengami | |
| 2003/0183631 | A1* | 10/2003 | Cross et al. | 220/203.17 |
| 2004/0217083 | A1* | 11/2004 | Mavin et al. | 215/253 |
| 2008/0210691 | A1* | 9/2008 | Yoshinari et al. | 220/560.03 |

FOREIGN PATENT DOCUMENTS

| | | |
|---|---|---|
| DE | 198 10 550 | 3/1999 |
| EP | 339729 A1 * | 11/1989 |
| EP | 0 836 884 | 4/1998 |
| JP | 5541344 | 10/1981 |
| JP | 57127852 | 8/1982 |
| JP | 5832345 | 2/1983 |
| JP | 59-32644 | 2/1984 |
| JP | 02234061 | 9/1990 |
| JP | 10132713 | 5/1998 |
| WO | WO 00/64755 | 11/2000 |

* cited by examiner

COVER WITH RECLOSEABLE APERTURE

BACKGROUND ART

The present invention relates to a cover for sealing a container.

A rigid closure element for a flexible container is described in WO 00/64755 A2. US 2003/0052126 A1 discloses a container lid with selectable opening. Other closeable containers are disclosed e.g. in DE 8716420 U1, US 2003/0168501 A1, or U.S. Pat. No. 6,037,168 A.

The volume of liquids used for chemical analysis is often very small and can be in the range of a few microliters. To protect such liquid against evaporation, it is necessary to cover the container in which the liquid is placed with a cap or similar means. The cap is preferably airtight.

In an known example, a well plate having a plurality of containers, each container containing a liquid to by analyzed, is covered and made airtight by a cover and preferably a foil. The cover might be glued or welded onto the well plate after the containers are filled with liquid. The cover or foil, respectively, comprises aluminum for example. If the liquid in a container of such a well plate is to be analyzed, a pipette or a glass capillary will hole through the cover and retrieve the liquid.

The holing procedure, however, might damage the glass capillary or contaminate the liquid. Further, the liquid in the container will start to evaporate due to the remaining hole.

EP 0836884 A2 discloses a cover for a container for providing a contamination free use of thermal reaction processes. The teaching thereof forms the preamble to claim 1.

DISCLOSURE OF THE INVENTION

It is an object of the present invention to provide improved sealing for a container. This object is solved by the independent claim. Other embodiments of the invention are subject of further dependent claims.

For chemical analysis, the substance to be analyzed is often dissolved within a solvent and the filled into a container. Sometimes liquid itself is the substance to be analyzed. The container, however, in which the solvent or the liquid is filled before further processing, comprises only a small volume in the range of few milliliters down to sub-microliters. It is therefore desired that evaporation of the liquid is kept as small as possible. Any direct connection with open air should be prevented.

An improved sealing is achieved by a cover for sealing a container or a vessel comprising a first layer (also called bottom layer) and a second layer (also called top layer) which is arranged over the first layer. The first and the second layers are structured to each provide a bending axis thus forming a recloseable aperture. The recloseable aperture will reduce or prevent evaporation of the liquid and further provide an easy access for a pipette or a glass capillary. Using a recloseable aperture can reduce or prevent damaging such pipette or contamination of the liquid. As soon as the liquid is retrieved from the container and the (glass) capillary or pipette is removed from the container, the aperture closes again. Using at least two layers arranged over each other allows a better airproof performance. Preferably the cover for sealing a liquid is formed as a foil, while the top and bottom layers are two different foil layers.

In a first embodiment of the invention at least one of the layers comprises a flap. In a second embodiment at least one of those two layers comprises a butterfly valve. The baffle as well as the butterfly valve is able to seal the aperture hermetically, thus preventing any liquid from evaporation.

In a further embodiment at least one of said first layer and said second layer comprises a shutter, a baffle or a damper. Preferably the top and the bottom layers each comprise a baffle, butterfly valve, damper, shutter or flap or any other means and structure, respectively, that allows forming a recloseable aperture through the cover. In another embodiment the top and bottom foil layers comprise a flap, shutter, or butterfly valve.

In an embodiment at least one of the top or bottom layer is structured with a U-shaped cut through the layer, thus forming the baffle, butterfly valve, clapper, shutter or flap. Forming the flap or the butterfly valve by using a U-shaped cut in at least one of the first and second layers allows reducing production costs, and the material used for the top or bottom layer can be used for the baffle of the butterfly valve as well.

The baffle, butterfly valve, shutter, damper, or flap each comprises a bending axis. The shutter, flap, damper, baffle or butterfly valve bends along that axis. In one embodiment the bending axis is mainly parallel along the connection of the baffle, butterfly valve, shutter or flap with the remaining layer material. In such case the bending axis is formed as a bending fold or a snap-off fold respectively. In case of a U-shaped cut in the respective layer, the bending axis is formed between the edges of the parallel sides of the U-shaped cut.

The snap-off fold or bending axis of said baffle or butterfly valve, shutter, flap or clapper of the first and second layers are arranged not to be over each other. This improves the closing behavior of the recloseable aperture. Furthermore the sealing effect by the two layers against air is improved.

In a further embodiment at least one of the first and second layers comprises a cross-shaped cut forming a recloseable valve having four parts. Each part of the recloseable valve comprises a bending axis. In a further embodiment the first and the second layers each comprise a cross-shaped cut, wherein the cross-shaped cut of the second foil layer is arranged with an offset of about 45° to the cross-shaped cut of the first layer. In another embodiment the top layer comprises a diaphragm-like recloseable aperture.

The different structures of the top and the bottom layers are forming the recloseable apertures. However, small amounts of air can flow through the cut(s) forming the structures. Due to the arrangement of at least the top layer on to the second layer, the probability of air flowing through both cuts is significantly reduced. Such arrangement is considered airtight against evaporation of a liquid in a container arranged below the recloseable aperture. The different apertures of the top and the bottom layer can be arranged in any combination.

In an embodiment the top and bottom layers are glued together by polymerization in the area around the recloseable aperture. In another embodiment the top layer is laminated at least partly onto the second layer, thereby forming a strong and airtight connection. Preferably the top and bottom layers are foil layers in this embodiment.

In a further embodiment the cover comprises a moveable third layer arranged between the top and bottom layers. The moveable third layer is used for closing an aperture in the first and second layers. In an embodiment the movable third layer is formed as a movable foil layer between the first and second layer. In this embodiment the third layer is structured to form a sliding valve. Using the third layer (or a third foil layer) in-between the top and bottom layers structured as a sliding valve allows an easy way to open the aperture, for example when inserting a pipette, and closing the aperture in the cover to prevent liquid from evaporation. Such embodiment allows access to the liquid directly without contacting the cover, thereby preventing contamination of the liquid through picking of material on the cover's surface.

In an embodiment the cover comprises means for moving the third layer for closing the aperture. Such means can be formed as an anchor, hook or the like. In another embodiment the cover comprises a seal material arranged at least between the third moveable layer and the bottom layer in the area of the recloseable aperture.

The seal can prevent an air connection between the third moveable layer and the bottom layer. The seal comprises, for example, Teflon, Silicon, PTFE (Poly-Tetra-Fluor-Etylene) or any other polyimide and is preferably structured as a ring around the aperture's area. Other materials can also be used for the seal.

In yet another embodiment the recloseable aperture is ring-shaped, or elliptical. In a further embodiment the recloseable aperture is formed as an approximately rectangular recloseable aperture.

In one embodiment, at least one layer comprises a polyamide, polyimid, or polyester material. It can also comprise any other polymer compound including liquid crystal polymer compounds. In a further embodiment the top layer comprises an electrically conductive coating layer. For example, the top layer might comprise aluminum. The cover itself can have a thickness smaller than 400 μm. Preferably, each layer of the cover comprises a thickness of about 40 to 100 μm. In an embodiment the recloseable aperture of the cover comprises an area smaller than 60 $mm^2$. More specifically a diameter of the cover's aperture can have about the same size as a diameter of the pipette or glass capillary when inserted into the container to take in some liquid.

In a further embodiment the cover comprises a plurality of recloseable apertures. Such cover is used for sealing a well plate, a micro well plate or a micro plate. The well plate comprises a plurality of liquid containers. The arrangement of the cover according to the invention on top of the well plate allows sealing its containers airtight, while still having the possibility of easy access to the liquid within the containers. The cover is prevented from being damaged during liquid retrieving. The different forms of recloseable apertures in the first, second and third layers can be combined independently from each other. They can be adapted as foil layer arranged on top of and connected to each other. Higher protection against evaporation of the liquid in the container can be achieved by arranging additional layers with a recloseable aperture between or onto the first or second layers.

BRIEF DESCRIPTION OF DRAWINGS

Other objects and many of the attendant advantages of embodiments of the present invention will be readily appreciated and become better understood by reference to the following more detailed description of preferred embodiments in connection with the accompanied drawings. All figures are simplified schematic representations presented for illustrations purposes only and do not limit the invention or the scope of protection. Features that are substantially or functionally equal or similar will be referred to with the same reference sign(s).

DETAILED DESCRIPTION OF EMBODIMENTS OF THE INVENTION

Figure 1:
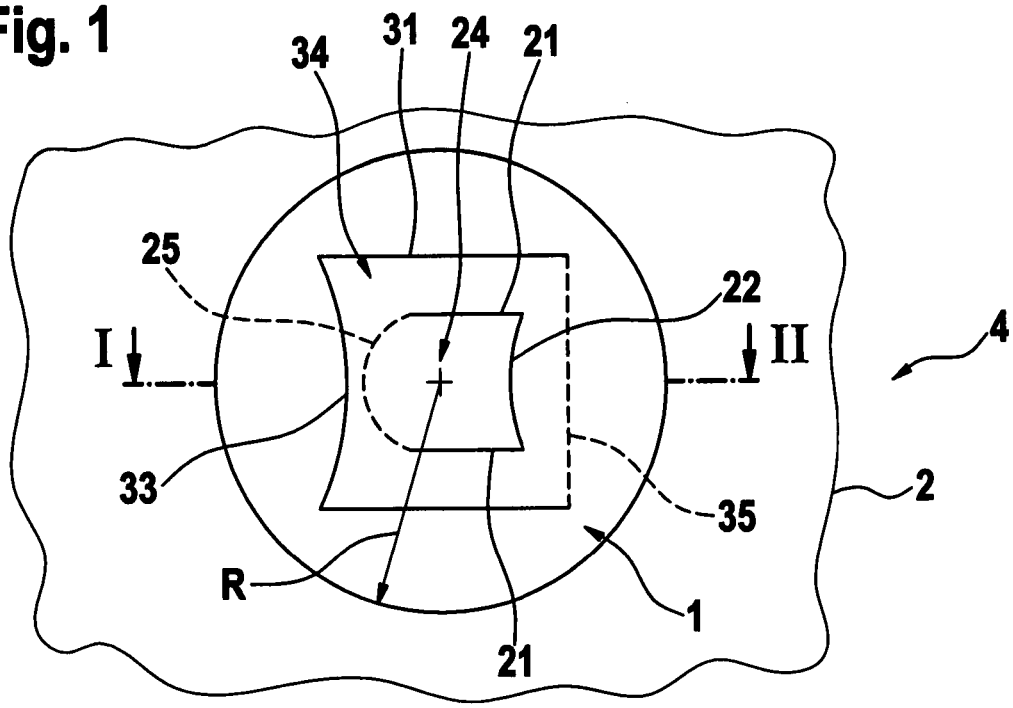
FIG. 1 shows a schematic top view of a first embodiment of the invention.
Figure 2:
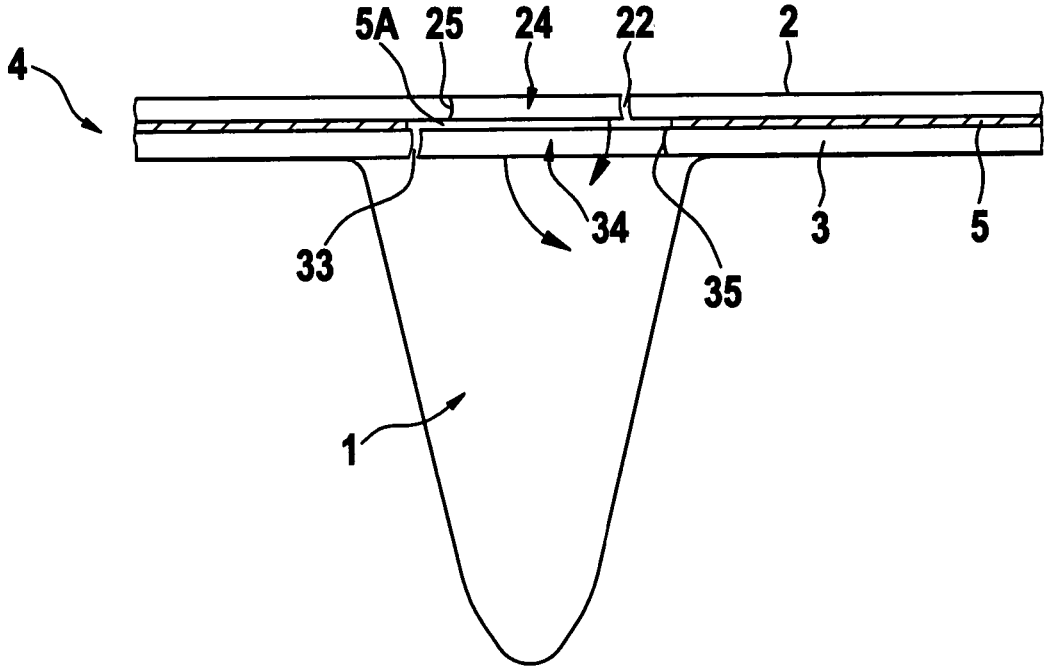
FIG. 2 shows a schematic view through the I-II-plane of FIG. 1.

Referring now to FIGS. 1 and 2, which show a top and a side view along the I-II plane of a cover 4 according to a first embodiment of the present invention. The cover is formed as a foil 4. The foil covers a container 1 for a liquid and is connected to that container. The container 1 is part of a well plate not shown here. The container 1 is formed as a cone with a radius R on its upper side, which is indicated in FIG. 1 as a ring. The radius R of the container 1 is larger than any dimension of the recloseable opening of the foil 3. Opening the cover 4 or foil respectively will allow access to a liquid placed in the container 1.

The foil 4 comprises a top foil layer 2. The top foil layer 2 comprises a recloseable aperture 24 arranged directly over a second recloseable aperture 34 of a bottom foil layer 3. Both recloseable apertures 24 and 34 are structures as flaps.

The aperture 24 is formed by two parallel cuts 21 in the foil layer 2 and a slightly U-shaped cut mainly perpendicular to both cuts 21. Furthermore the recloseable aperture 24 of the top foil layer 2 comprises a bending axis 25. The foil layer material forming the aperture 24 bends along the line 25 when pushed down or pulled up. The bending axis 25 as indicated by the dashed line is also slightly U-shaped in order to generate tension when pushed down. The bending fold axis 25 is formed automatically, if three sides are cut. However, in this embodiment the top foil layer is slightly slit along the line 25 in order to form a preferred bending axis. The tension automatically recloses the aperture, when the top foil layer 2 in the area 24 is pushed down and released. The cuts in the foil layer are produced by a laser induced cutting process, resulting in very small gaps between the foil layer in area 24 and the surrounding foil layer. Instead of laser induced cutting, different method like micro stamping or other alternatives can be used. The cuts produced by such methods are too small to allow greater amounts of air flowing through those gaps.

The top layer 2 is bonded onto a bottom layer 3. The bottom layer 3 also comprises a recloseable aperture 34, which comprises a larger area than the recloseable aperture 24 of top layer 2. The recloseable aperture 34 is formed by two parallel cuts 31 and a further slightly U-shaped cut 33. The cuts 31 are approximately parallel to the cuts 21 forming the recloseable aperture 24 or flap 24 of top foil layer 2.

The fourth side 35 of the recloseable aperture 34 forms a bending axis or bending fold 35, as indicated by the dashed line. The cuts 31 and 33 are very small. Furthermore, the top layer 2 with the recloseable aperture 24 is bonded directly on the bottom layer 3. The area 24 is connected directly to the area 34 resulting in a very small or even no volume 5A between the recloseable apertures of both foil layers. The cuts 21, 22 as well as 31, 33 of top layer 2 and bottom layer 3 are formed on different areas. Any air flowing through one of those cuts has to move along the very small area 5A in between the two recloseable apertures and then through one of the cuts of the other foil layer. The likelihood of such airflow is very small. Therefore, the arrangement of top layer 2 onto bottom layer 3 each with a recloseable aperture significantly reduces or even prevents airflow from outside into container 1. Evaporation of a liquid within container 1 can be prevented.

To gain access to the container 1, the recloseable aperture of the foil has to be opened. This can be achieved by pushing onto the areas 24 and 34, thereby opening each flap in the foil layers 2 and 3. Pushing down movable foil layers 24 and 34 reduces the pressure exerted by the pipette or a glass capillary. Damage to the pipette can be prevented. Due to the arrangement of the bending axes 25 and 35 on opposite sides, the foil layers in the area 24 and 34 open in different directions. The flap 24 of foil layer 2 opens in a clock-wise direction, while the recloseable aperture 34 of bottom layer 3 opens counter-clockwise. This structure further improves the sealing effect.

Figure 3A:
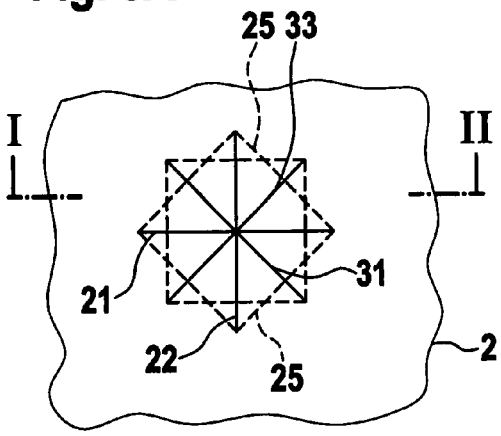
FIG. 3A to FIG. 7B show the top views as well as side views through the I-II-plane of different embodiments of the invention.
Figure 3B:
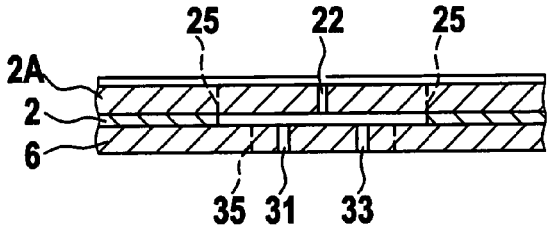

Referring now to FIGS. 3A and 3B, FIG. 3A shows a top view of another embodiment of the invention. The top layer 2 is a foil layer and comprises two cuts 21 and 22. The cuts 21 and 22 are arranged with an offset of 90° and forming a cross-shaped cut in the top layer 2. Together with their bending folds 25, the cuts 21 and 22 form four virtual triangle structures as flaps or butterfly valves for top layer 2. The top layer 2 also comprises a top layer coating 2A. The top layer coating 2A is made of a metal, for example aluminum, and covers the area of the butterfly valve. The metal coating 2A allows a better positioning of a pipette or a glass capillary in an attempt for withdrawing liquid from a container. The positioning of a pipette is described in EP 1464965 B1 by the same applicant.

The top layer 2 is connected by a lamination layer 6 to a bottom layer 3. The bottom layer 3 is also formed as a foil layer and comprises two cuts 31 and 33, forming a cross-shaped cut, and thereby structures as butterfly valve as well. The intersection of the cuts 31 and 33 is arranged under the intersection of the cuts 21 and 22 of top foil layer 2. Furthermore, the cross-shaped cuts of both foil layers 2 and 3 are arranged with an offset of approximately 45°.

Figure 4A:
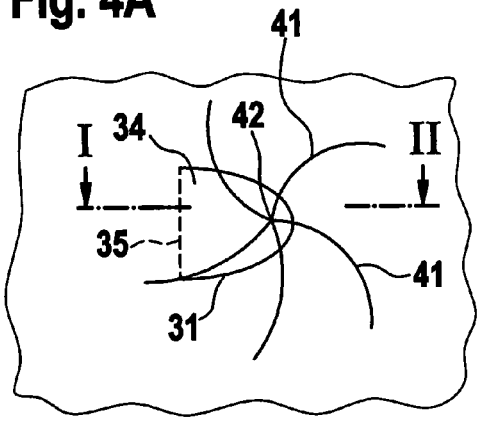
Figure 4B:
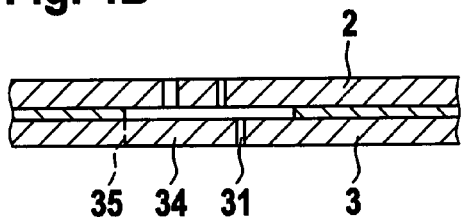

Referring now to FIG. 4A and FIG. 4B. The top layer 2 and the bottom layer 2 are connected together by polymerization to form the cover. During the fabrication process, the top layer 2 as well as the bottom layer 3 are not completely polymerized. After processing of each layer, the recloseable apertures in each layer are formed. Then, the top layer 2 is arranged over the bottom layer 3. After such arrangement, the process for the remaining polymerization procedure is performed. The polymerization process connects the top layer 2 to the bottom layer 3, thereby leaving the area of the recloseable apertures of top and bottom layers unconnected.

The top layer 2 comprises a diaphragm-like cut 41, in this example having five curved cuts. Each cut is curved in a spiral like manner with an increasing radius starting from the center point 42. The resulting structure covers an area slightly larger than the area of the recloseable aperture of bottom layer 3. Bottom layer 3 comprises the recloseable aperture 34 with a parabolic formed cut. The center point 42 is arranged over the focal point of the parabolic recloseable aperture 34 of bottom layer 3. Of course, it can be arranged anywhere over the aperture 34.

Figure 5A:
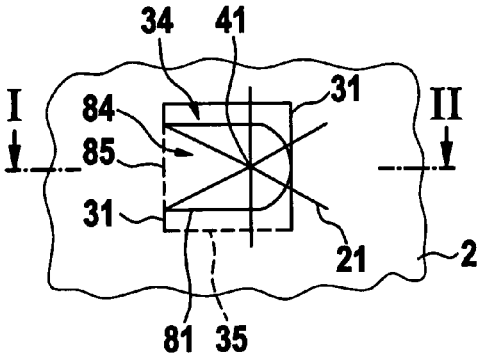
Figure 5B:
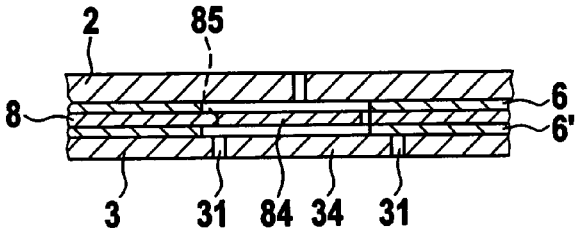

Referring now to FIGS. 5A and 5B. The cover of FIG. 5A comprises three foil layers 2, 3 and 8. The top foil layer 2 is laminated to the middle foil layer 8 by a lamination process. The foil layer 8 is laminated to the bottom foil layer 3. The lamination layers 6 and 6A are small compared to the foil layers 2, 3 and 8.

Top foil layer 2 of the foil according to the embodiment of FIG. 5A comprises three cuts, thereby forming a star. The center point 41 is arranged over a recloseable aperture 84 of middle foil layer 8. The aperture 84 of the third foil layer 8 is formed as a flap with a bending fold axis 85 arranged directly over a cut 31 forming a recloseable aperture 34 of the bottom foil layer 3. The bending axis 85 of the recloseable aperture 84 and the bending fold axis 35 of the aperture 34 are indicated by dashed lines. They are shifted by an offset of 90°. The area of the recloseable aperture 34 is slightly larger than the area of the recloseable aperture 85, which is also smaller than the area of the recloseable aperture of top foil layer 2.

When retrieving a liquid from a container arranged below the recloseable aperture of the inventive foil by a pipette or a glass capillary, the pipette has to be pushed through the recloseable apertures of foil layers 2, 8 and 3. After removal of the pipette, the apertures of layers 3, 8, 2 are closing again, thereby preventing evaporation of the remaining liquid in the container.

Figure 6A:
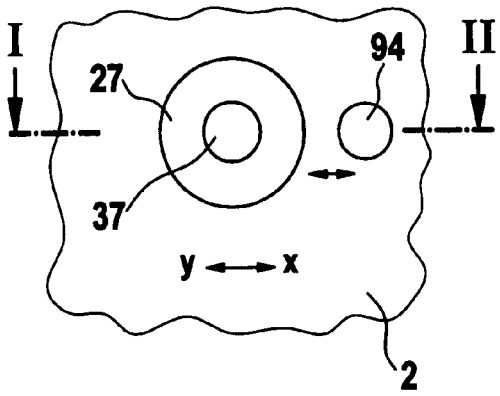
Figure 6B:
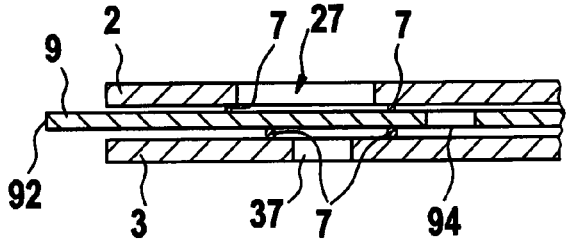

Referring now to FIG. 6A and FIG. 6B, showing another preferred embodiment of the present invention. The cover comprises a top layer 2 having a circular hole 27. A diameter of the hole is about the maximum diameter of a pipette or a glass capillary used for retrieving the liquid. The cover further comprises a bottom layer 3 also having a circular hole 37. The hole 37 is arranged directly under the hole 27 of the top layer 2. A foil layer 9 is arranged between the top layer 2 and the bottom layer 3. This third layer 9 is moveable and can be pulled along the direction of the I-II-plane. The third foil layer 9 comprises a hole 94. By pulling the foil layer 9 using an anchor 92, the hole 94 can be arranged directly over the aperture 37 of bottom layer 3. Thereby, the middle foil layer 9 provides a sliding valve opening any container arranged below the aperture 37 of the bottom foil layer 3.

Since the foil layer 9 is moveable between the top layer 2 and the bottom layer 3, a small amount of air might flow into a small volume between the layer 9 and the bottom layer 3. Seals 7 are provided in order to prevent evaporation of liquid out of the container. The seals 7 preferably comprise Teflon or Silicon and are adapted to form a ring around the aperture 37. The seals 7 are airtight and connected to the surface of bottom layer 3. They might comprise a microstructure onto their surfaces resulting in an even better sealing behavior. The seals 7 can prevent air in the small area between the foil layer 9 and bottom layer 3 from flowing into the container, while pulling or pushing the foil layer 9 arranged between top layer 2 and bottom layer 3.

Figure 7A:
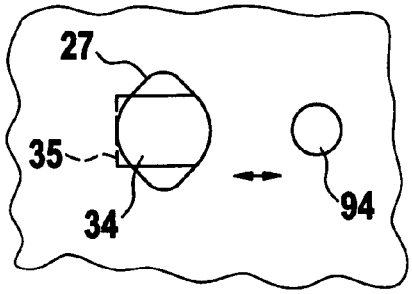
Figure 7B:
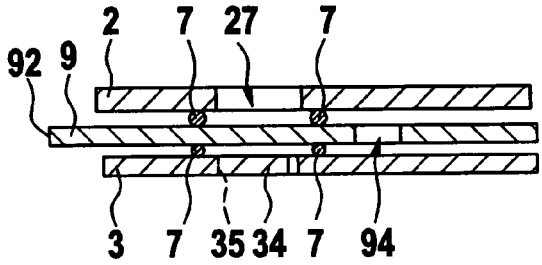

Referring now to FIG. 7A and FIG. 7B showing another embodiment of the present invention. The cover in this embodiment comprises a top layer 2, a bottom layer 3, and a foil layer 9 arranged between the top and bottom layer. The top layer 2 comprises an ellipsoid aperture 27. The foil layer 9 comprises a hook 92 for connecting the layer 9 to an outside system in order to pull or push the foil layer 9. It further comprises a circle aperture 94. By moving the foil layer 9, the aperture 94 is arranged under the aperture 27 of top layer 2. The bottom layer 3 comprises a recloseable aperture 34. The recloseable aperture is formed as a flap or shutter with its bending fold axis 35 arranged under the opening 27 of top layer 2. Furthermore, seals 7 between the top layer 2 and the middle layer 9 as well as between the middle layer 2 and bottom layer 3 are provided. Evaporation of liquid within a container into the volumes between the top layer 2 and the middle layer 9 or between the bottom layer 3 and the middle layer 9, respectively, can thereby be prevented. Protection against evaporation is improved due to the recloseable aperture 34 of bottom layer 3 and the moveable foil layer 9.

A further improvement is to implement a recloseable aperture into the movable middle layer 9. In order to get access to a container arranged under the recloseable aperture of the inventive cover, the middle movable layer 9 is moved until its recloseable aperture is arranged under the aperture 27 of top layer 2. A pipette or similar means to open the recloseable aperture of the inventive cover is used to push down the apertures of layers 9 and 3. After processing the liquid, the pipette is removed, and the container closes again.

Figure 8:
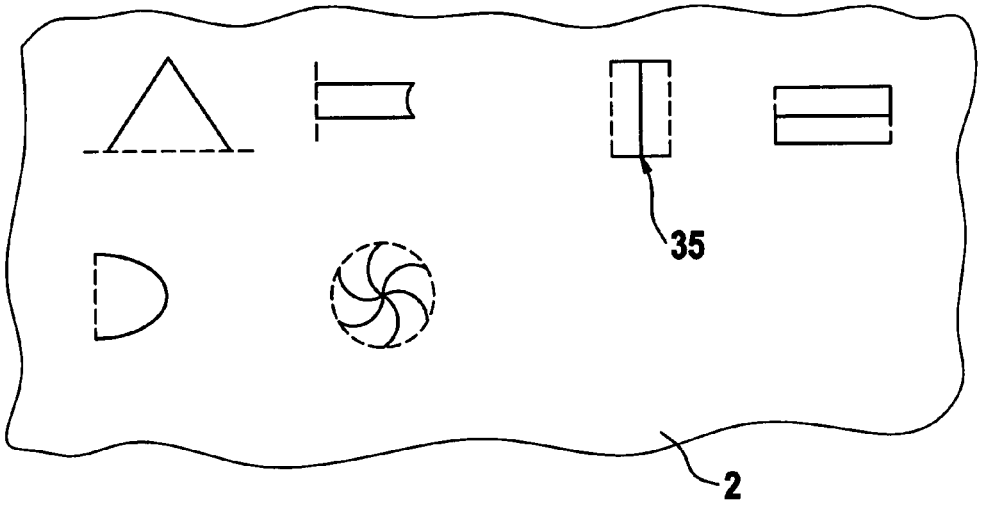
FIG. 8 shows different recloseable apertures together with their bending axes.

Referring now to FIG. 8 showing different embodiments of recloseable apertures of a foil layer. The dashed lines indicate the bending axes of the recloseable apertures. The continuous lines are cuts in the foil layer material. The cuts 35 are forming a butterfly valve, while all other examples form shutters, baffles or simple flaps. The foil layer material used to structure recloseable apertures is firm or rigid, respectively, to assure reclosing after the aperture has been opened by pushing or pulling the foil layer material.

Different layers with different recloseable apertures can be arranged in order to form the cover with the recloseable aperture according to the scope of the invention. The different layers can be made of the same material, for example polyamide or polyester or any other organic material. Polyimide material can also be used. The layers can also comprise a coating layer, for example a metal alloy or an additional seal layer. For example, it might be useful to use silicon as a coating layer on the top and bottom layer in order to reclose the cuts forming the recloseable apertures. The areas of the recloseable apertures for each layer can be of different size. For example, the area of the recloseable aperture of the top layer can be smaller than the area of the bottom layer. However, it must be as large as the maximum diameter of the pipette or a glass capillary means, which is used to retrieve the liquid from the underlying container. It is also useful that the diameter of the recloseable aperture of the cover is smaller than the maximum diameter of the container to be sealed.

Figure 9:
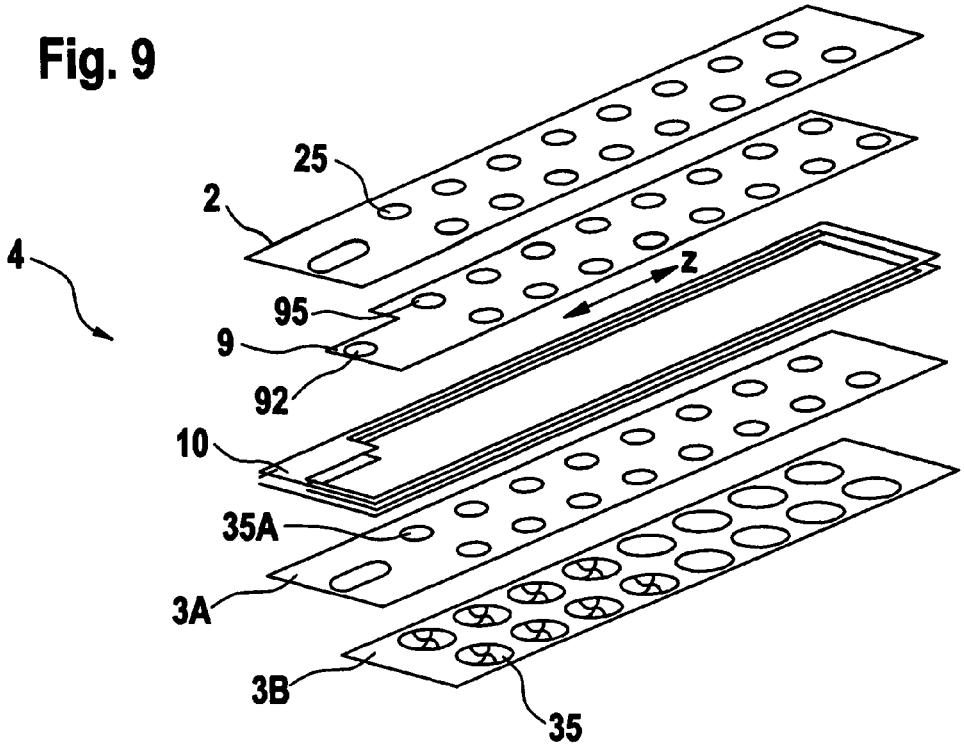
FIG. 9 shows a schematic "explosion" view of a further embodiment of the invention.
Figure 10:
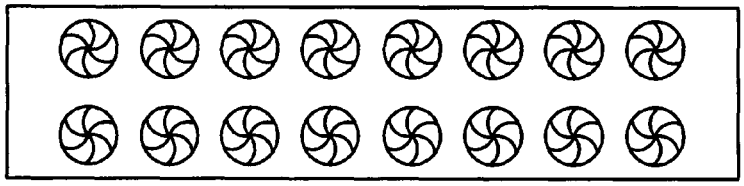
FIG. 10 shows the top view of a sealing cover for a well plate.
Figure 10:
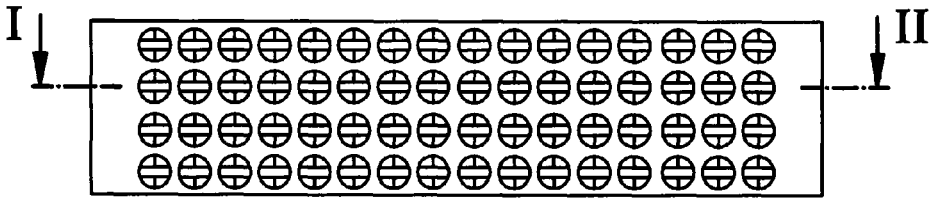

Referring now to FIG. 9 showing a schematic explosion view of an inventive cover with different foil layers for a well plate having a plurality of containers. The bottom view of such cover can be seen in FIG. 10. The cover of FIG. 9 comprises a top foil layer 2. The top foil layer 2 is arranged over a moveable foil layer 9. The layer 9 comprises an anchor 92 and holes 95. The anchor is used to pull or push the layer 9 along the z-axis indicated in FIG. 9. Additionally, layer 2 and movable layer 9 are structured in a way to reduce sliding friction between them. The sliding friction is increased, if an area of direct contact between layer 2 and layer 9 is large. The effect further increases, if water molecules settle in the space between movable layer 9 and layer 2. To reduce area of direct contact, both surfaces of layers 9 and 2 are nanostructured. This can be achieved by etching both layers. The surface of both layers becomes rough on microscopic scale, resulting in smaller area of direct contact. Additionally, the surface of layer 2 is reduced by structuring the layer differently compared to movable layer 9. For example, additional holes can be inserted.

Furthermore, a seal 10 is arranged between the moveable foil layer 9 and a third foil layer 3A. Finally, a fourth foil layer 3B with recloseable apertures 35 is arranged under the apertures of foil layer 3A. The recloseable apertures 35 of foil layer 3A are structured in a diaphragm like manner as it can also be seen in FIG. 4.

The cover or foil, respectively, can be used to seal a well plate having a plurality of containers for liquids. Before filling the containers with liquids, the cover or foil is glued or welded onto the well plate, thereby sealing the containers and preventing the liquids from evaporation. Furthermore the cover might be welded to the plate between the different containers of the plate, thereby preventing liquid exchange between the containers. For filling and retrieving any liquids from one of the containers, the moveable foil 9 is pushed or pulled until its apertures 95 are arranged under the apertures 25 of the top layer 2 and above the apertures 35A of the layer 3A. However, the recloseable aperture 35 of bottom layer 3B will still prevent evaporation of liquids in containers not needed.

Figure 11:
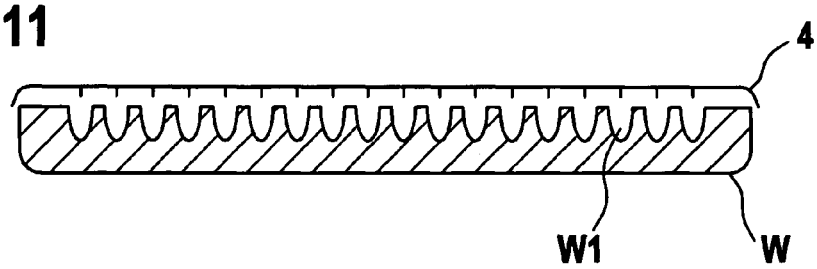
FIG. 11 shows another top view of a three-layer sealing cover used to seal a well plate comprising a plurality of containers.

Referring now to FIG. 11. FIG. 11 shows a top view of a foil according to one embodiment used for sealing a well plate W with a plurality of containers W1.

The foil comprises a foil layer having a plurality of butterfly valves. The recloseable apertures of the foil are arranged above the containers W1 of the well plate W. The foil is connected to the well plate W.

What is claimed is:

1. Cover for sealing a container comprising:

at least one bottom layer and at least one top layer arranged over said bottom layer;

the bottom and top layer each comprising a structure to form a recloseable aperture of the cover and allowing access through the layers into the container; and a movable layer arranged to be movable in a plane between the at least one bottom layer and the at least one top layer for closing an aperture in the bottom and top layer, wherein the bottom and top layer are glued together by polymerization.

2. Cover of claim 1, wherein at least one of the said bottom layer and top layer comprises at least one of: a recloseable aperture, a flap, and a butterfly valve.

3. Cover of claim 2, wherein said flap or said butterfly valve is formed by a U-shaped cut in the layer.

4. Cover of claim 3, wherein a bending fold axis of said flap or butterfly valve of the at least one bottom layer is not arranged over a bending fold axis of said flap or butterfly valve of the at least one top layer.

5. Cover of claim 1, wherein at least one of the at least one bottom and the at least one top layer comprises a cross-shaped cut thereby forming a butterfly valve.

6. Cover of claim 5, wherein the cross-shaped cut of the at least one top layer is arranged with an offset of approximately 45° to the cross-shaped cut of the at least one bottom layer.

7. Cover of claim 1, wherein at least the top layer comprises a diaphragm-like recloseable aperture.

8. Cover of claim 1, wherein the bottom layer is laminated at least partly onto the top layer.

9. Cover of claim 1, wherein said movable layer is structured to form a sliding valve.

10. Cover of claim 1, wherein the movable layer comprises means for moving the movable layer for closing the aperture of the cover.

11. Cover of claim 1, wherein the cover comprises a seal arranged at least between the movable layer and the at least one bottom layer in the area of the recloseable aperture.

12. Cover of claim 11, wherein the seal comprises at least one of the following materials: Teflon or a Teflon co-polymer, Silicone, PTFE.

13. Cover of claim 1, wherein the recloseable aperture is ring-shaped, elliptical or approximately rectangular.

14. Cover of claim 1, wherein at least one layer comprises polyimide or polyimide or polyester or liquid crystal polymer.

15. Cover of claim 1, wherein the top layer comprises an electrically conductive coating layer.

16. Cover of claim 1, wherein the top layer comprises a metal coating layer.

17. Cover of claim 1, wherein the cover thickness is smaller than 400 um.

18. Cover of claim 1, wherein the recloseable aperture of the cover comprises an area smaller than 60 $mm^2$.

19. Cover of claim 1, comprising a plurality of recloseable apertures for sealing a well plate, said well plate comprising a plurality of containers for a liquid.

20. Cover of claim 19, wherein the cover is glued onto the well plate.

21. Cover of claim 19, wherein the cover is welded onto the well plate.

22. Cover of claim 19, wherein the bottom layer of the cover is airtight connected to the well plate material around a container of the well plate.

23. Method of retrieving or filling a liquid in a well plate having a plurality of containers for liquids, the method comprising:

providing the well plate with a cover arranged on top of the well plate, said cover comprising at least one bottom layer and at least one top layer arranged over said bottom layer, the bottom and top layer each comprising a structure to form a plurality of recloseable apertures sealing the containers and allowing access through the layers into the containers, and a movable layer arranged between the at least one bottom layer and the at least one top layer for closing the apertures in the bottom and top layer, wherein the bottom and top layer are glued together by polymerization;

opening the recloseable aperture of at least one container of the well plate;

retrieving or filling the liquid from the opened container or into the opened container;

closing the opened aperture after retrievement or filling.

24. Cover for sealing a container, comprising:

at least two layers arranged over each other for sealing the container and being structured to form a recloseable aperture of the cover, wherein each layer comprises a structure allowing to access, when the structures overlap, through the layers into the container; and a movable layer arranged to be movable in a plane between the at least two layers for closing the aperture of the cover, wherein the at least two layers are glued together by polymerization.

25. Cover for sealing a container comprising:

at least one bottom layer and at least one top layer arranged over said bottom layer;

the bottom and top layer each comprising a recloseable aperture of the cover, arranged directly over each other and allowing access through the layers into the container; wherein a bending fold axis of each reclosable aperture is arranged on an opposite side of the cover;

a movable layer arranged to be movable in a plane between the at least one bottom layer and the at least one top layer for closing the apertures in the bottom and top layer, wherein the bottom and top layer are glued together by polymerization.

* * * * *

UNITED STATES PATENT AND TRADEMARK OFFICE

CERTIFICATE OF CORRECTION

PATENT NO. : 8,152,016 B2
APPLICATION NO. : 10/589319
DATED : April 10, 2012
INVENTOR(S) : Manfred Berndt et al.

It is certified that error appears in the above-identified patent and that said Letters Patent is hereby corrected as shown below:

In column 8, line 65, in Claim 17, delete "um." and insert -- μm. --, therefor.

Signed and Sealed this
Twenty-ninth Day of May, 2012

David J. Kappos

David J. Kappos
*Director of the United States Patent and Trademark Office*